US010276934B2

(12) United States Patent
Li et al.

(10) Patent No.: US 10,276,934 B2
(45) Date of Patent: Apr. 30, 2019

(54) ANTENNA STRUCTURE

(71) Applicant: Wistron NeWeb Corporation, Hsinchu (TW)

(72) Inventors: Pei Kun Li, Hsinchu (TW); Chung Yen Hsiao, Hsinchu (TW); Huang Tse Peng, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 15/820,492

(22) Filed: Nov. 22, 2017

(65) Prior Publication Data

US 2018/0254556 A1 Sep. 6, 2018

Related U.S. Application Data

(60) Provisional application No. 62/466,342, filed on Mar. 2, 2017.

(30) Foreign Application Priority Data

Jul. 14, 2017 (TW) ..... 106123622 A

(51) Int. Cl.
*H01Q 1/24* (2006.01)
*H01Q 5/30* (2015.01)
(Continued)

(52) U.S. Cl.
CPC ..... *H01Q 5/30* (2015.01); *H01Q 1/2291* (2013.01); *H01Q 1/243* (2013.01); *H01Q 1/273* (2013.01);
(Continued)

(58) Field of Classification Search
CPC ..... H01Q 1/243; H01Q 1/48; H01Q 9/0407; H01Q 7/00; H01Q 5/30
(Continued)

(56) References Cited

U.S. PATENT DOCUMENTS 6,693,599 B1 * 2/2004 Chia ..... H01Q 1/2225 340/505
7,079,079 B2 * 7/2006 Jo ..... H01Q 1/243 343/700 MS
(Continued)

FOREIGN PATENT DOCUMENTS

TW 201619755 A 6/2016

OTHER PUBLICATIONS

TW Office Action dated May 17, 2018 in corresponding Taiwan application (No. 106123622).

*Primary Examiner* — Dameon E Levi
*Assistant Examiner* — Hasan Z Islam
(74) *Attorney, Agent, or Firm* — McClure, Qualey & Rodack, LLP

(57) ABSTRACT

An antenna structure includes a ground element and a metal loop. The metal loop includes a main radiation element and a float radiation element. The main radiation element has a feeding point, a first shorting point, and a second shorting point. The first shorting point and the second shorting point are both coupled to the ground element. The feeding point is substantially positioned between the first shorting point and the second shorting point. The float radiation element is adjacent to the main radiation element, and is separated from the ground element and the main radiation element. The ground element is substantially surrounded by the metal loop.

9 Claims, 4 Drawing Sheets

(51) Int. Cl.

| | |
|---|---|
| ***H01Q 1/38*** | (2006.01) |
| ***H01Q 7/00*** | (2006.01) |
| ***H01Q 9/04*** | (2006.01) |
| ***H01Q 1/48*** | (2006.01) |
| ***H01Q 21/28*** | (2006.01) |
| ***H01Q 13/10*** | (2006.01) |
| ***H01Q 1/22*** | (2006.01) |
| ***H01Q 1/27*** | (2006.01) |

(52) U.S. Cl.
CPC ..... *H01Q 1/38* (2013.01); *H01Q 1/48* (2013.01); *H01Q 7/00* (2013.01); *H01Q 9/0407* (2013.01); *H01Q 13/10* (2013.01); *H01Q 21/28* (2013.01)

(58) Field of Classification Search
USPC ..... 343/702
See application file for complete search history.

(56) References Cited

U.S. PATENT DOCUMENTS

| | | | | |
|---|---|---|---|---|
| 8,907,853 | B2 * | 12/2014 | Ying | H01Q 1/243 343/702 |
| 9,647,339 | B2 * | 5/2017 | Lo | H01Q 1/48 |
| 2012/0299785 | A1 * | 11/2012 | Bevelacqua | H01Q 9/42 343/702 |
| 2014/0292590 | A1 * | 10/2014 | Yoo | H01Q 1/243 343/702 |
| 2016/0156094 | A1 | 6/2016 | Lo et al. | |
| 2016/0164169 | A1 * | 6/2016 | Krogerus | H01Q 21/28 343/702 |

* cited by examiner

ANTENNA STRUCTURE

CROSS REFERENCE TO RELATED APPLICATIONS

This Application claims priority to U.S. provisional application Ser. No. 62/466,342, which was filed on Mar. 2, 2017 and Taiwan Patent Application No. 106123622 filed on Jul. 14, 2017, the entireties of which are incorporated by reference herein.

FIELD OF THE INVENTION

The present invention generally relates to antenna structures, and more particularly, to antenna structures that effectively cover mobile communication band.

BACKGROUND OF THE INVENTION

Generally, with the advancements being made in mobile communication technology, mobile devices such as portable computers, mobile phones, tablets, phablets, multimedia players, and other hybrid functional portable electronic devices have become more common. To satisfy consumer demand, mobile devices can usually perform wireless communication functions. Some devices cover a large wireless communication area which includes mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area which includes mobile phones using Wi-Fi and Bluetooth systems and using frequency bands of 2.4 GHz, 5.2 GHz, and 5.8 GHz.

According to some research reports, researchers predict that the next generation of mobile devices will be "wearable devices". For example, wireless communication may be applied to watches, glasses, and even any carry supplies in the future. However, wearable devices, for example, do not have a large enough space to accommodate antennas for wireless communication. Accordingly, this has become a critical challenge for antenna designers.

It is therefore desired to provide antenna structures that are effective in smaller spaces.

SUMMARY OF THE INVENTION

An aspect of the present invention is to provide an antenna structure that includes a ground element and a metal loop. The metal loop includes a main radiation element comprising a feeding point, a first shorting point and a second shorting point. The first shorting point and the second shorting point are coupled to the ground element, and the feeding point is substantially positioned between the first shorting point and the second shorting point. A float radiation element is adjacent to the main radiation element, and is separated from the ground element and the main radiation element, wherein the ground element is substantially surrounded by the metal loop.

Another aspect of the present invention is to provide an antenna structure that includes a ground element and a metal loop. The metal loop includes a feeding point and a shorting point. The shorting point is coupled to the ground element. The ground element is substantially surrounded by the metal loop.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
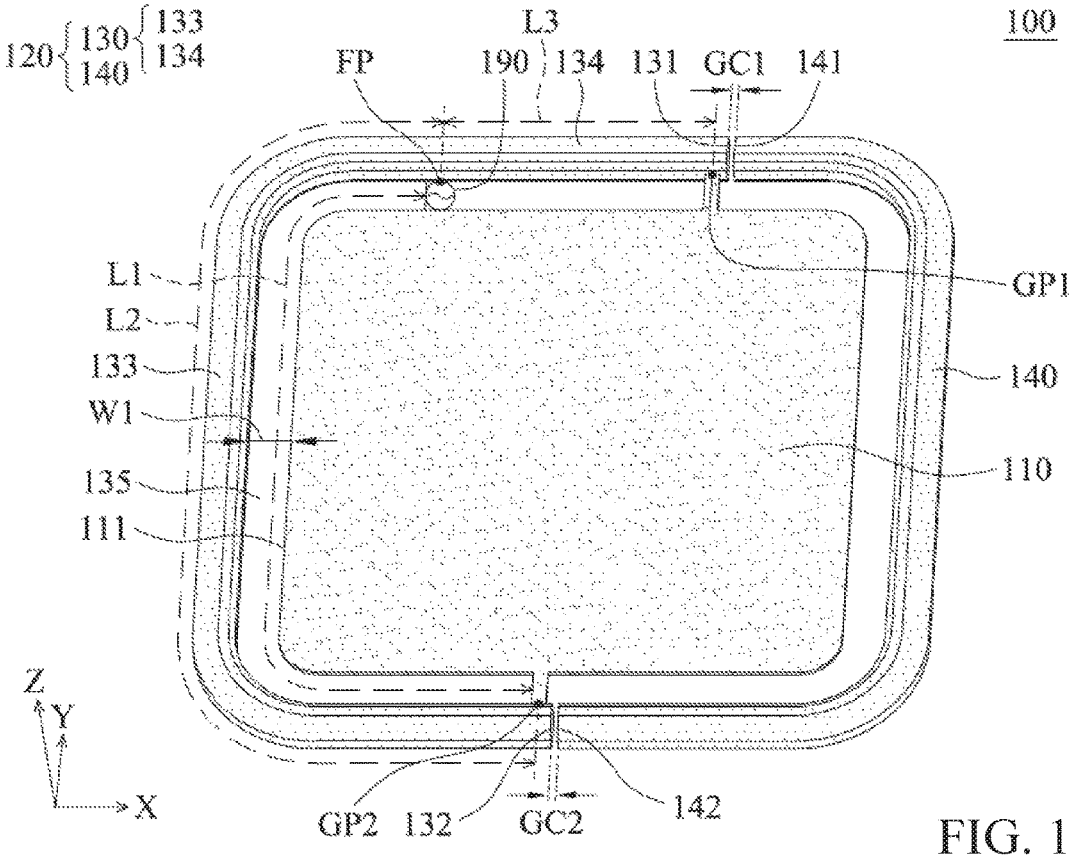
FIG. 1 is a perspective view of an antenna structure according to an embodiment of the present invention.

Reference will now be made in detail to the present preferred embodiments of the invention, examples of which are illustrated in the accompanying drawings. Wherever appropriate, the same or similar reference numbers are used in the drawings and the description to refer to the same or comparable parts. It is not intended to limit the method or the system by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

FIG. 1 is a perspective view of an antenna structure according to an embodiment of the present invention. The antenna structure 100 can be applied in a mobile device, a wearable device, or other hybrid functional portable electronic devices. In some embodiments, the antenna structure 100 can be combined with, for example, a key ring so that the key ring has the function of wireless communication, but the present invention is not limited thereto. In other embodiments, the antenna structure 100 can be combined with any small items so as to form a member of the Internet of Thing (IoT). As shown in FIG. 1, the antenna structure 100 includes a ground element 110 and a metal loop 120, the ground element 110 is substantially surrounded by the metal loop 120. For example, the ground element 110 can be a ground copper of a printed circuit board (PCB), and the metal loop 120 can be an appearance element, the visual properties of the metal can help to modify and beautify the appearance of the applied device.

The metal loop 120 includes a main radiation element 130 and a float radiation element 140, the main radiation element 130 and the float radiation element 140 are both extended along the ground element 110. The main radiation element 130 includes a feeding point FP, a first shorting point GP1 and a second shorting point GP2. The feeding point FP is coupled to a signal source 190, for example, the signal source 190 can be a radio frequency (RF) module, the RF module can be used to generate a transmit signal or to process a receive signal. The positive electrode of the signal source 190 may be coupled to the feeding point FP and the negative electrode of the signal source 190 may be coupled to the ground element 110. The first shorting point GP1 and the second shorting point GP2 are coupled to the ground element 110. The feeding point FP is substantially positioned between the first shorting point GP1 and the second shorting point GP2. The float radiation element 140 is adjacent to the ground element 110 and the main radiation element 130, and is separated from the ground element 110 and the main radiation element 130.

More specifically, the main radiation element 130 includes a first end 131 and a second end 132 away from each other, the first shorting point GP1 can be disposed on the first end 131 and the second shorting end GP2 can be disposed on the second end 132. The float radiation element 140 also includes a first end 141 and a second end 142 away from each other. A first coupling gap GC1 is formed between the first end 141 of the float radiation element 140 and the first end 131 of the main radiation element 130. A second coupling gap GC2 is formed between the second end 142 of the float radiation element 140 and the second end 132 of the main radiation element 130. In order to enhance the coupling effect between the elements, the width of the first coupling gap GC1 and the width of the second coupling gap GC2 are less than 20 mm.

According to the embodiment of the FIG. 1, the ground element 110 is a rectangular metal plate, and the four corners are modified for the arc angle. The metal loop 120 is a hollow rectangular frame and four corners are modified for the arc angle correspondingly. In detail, the main radiation element 130 may be substantially a longer U shaped, and the float radiation element 140 may be substantially a shorter U shaped. A length of the main radiation element 130 is larger than a length of the float radiation element 140. However, the present invention is not limited thereto. In other embodiments, the ground element 110 and the metal loop 120 can be changed to other different corresponding shape. For example, the ground element 110 can be a rectangular metal plate and the four corners are retained as a rectangular shape. The metal loop 120 can be substantially a hollow rectangular frame and the four corners are retained as a rectangular shape, too. In other embodiments, at least one of the corners of the ground element 110 may form a truncated angle.

According to the actual measurement results, when the antenna structure 100 is excited, the antenna structure 100 covers an operation frequency band, and the operation frequency band is from 2403 MHz to 2483.5 MHz. Therefore, the antenna structure 100 can support at least mobile communication frequency bands of Wi-Fi or Bluetooth.

The main radiation element 130 includes a radiation branch 133 and a tuning branch 134, the radiation branch 133 is disposed between the feeding point FP and the second shorting point GP2, the tuning branch 134 is disposed between the feeding point FP and the first shorting point GP1. The radiation branch 133 is substantially a C-shaped. The tuning branch 134 is substantially a straight stripe shape. The radiation branch 133 is extended along an edge of the ground element 110 so as to form a slot region 135 between the radiation branch 133 and the ground element 110, and the slot region 135 is a clearance area without metal, that is no metal components are disposed therein.

In principle, the radiation branch 133 is a higher portion of the current density of the antenna structure 100 as a main resonant path of the antenna structure 100. The tuning branch 134 is used to provide inductance characteristic to fine-tune the impedance matching of the antenna structure 100. One end of the radiation branch 133 is the feeding point FP and another end of the radiation branch 133 is the first shorting point GP1 coupled to the ground element 110. A combination of the radiation branch 133 and the ground element 110 may be considered as a loop antenna. In addition, the slot region 135 between the radiation branch 133 and the ground element 110 may be considered as a slot antenna.

Antenna structure 100 is a hybrid antenna that includes loop antenna and slot antenna. By integrating two different antenna configurations, the antenna structure 100 can have a preferred radiation pattern of the slot antenna and has a larger operation bandwidth of the loop antenna. On the other hand, the float radiation element 140 can be used as a director of the main radiation element 130 to modify the radiation pattern of the main radiation element 130. For example, when the main radiation direction of the antenna structure 100 is front and rear (e.g., the +Z, −Z axis direction in FIG. 1). The float radiation element 140 may be excited by the coupling of the main radiation element 130, and the coupling current thereon may generate radiation in the lateral direction (e.g., the +X, −X axis direction in FIG. 1) so that the antenna structure 100 can provide approximate omni-directional radiation pattern. Therefore, the antenna structure 100 can easily receive and transmit wireless signals in various directions.

The length L1 of the slot region 135 is substantially equal to one wavelength (1λ) of a central frequency of the operation frequency band, and the width W1 of the slot region 135 is greater than or equal to 2 mm. The range of the aforementioned length L1 and the width W1 contributes to maintaining the broadband characteristic of the antenna structure 100 (for example, if the width W1 of the slot region 135 is insufficient, the bandwidth of the slot antenna becomes narrower). Since the radiation branch 133 is close to the slot region 135, the length L2 of the radiation branch 133 is almost equal to (or slightly greater than) the length L1 of the slot region 135. In order to provide sufficient inductance characteristics, the length L3 of the tuning branch 134 can be less than 0.25 wavelength (0.25λ) of the central frequency of the operation band of the antenna structure 100.

The shape of ground element 110 and the metal loop 120 of the antenna structure 100 is not a limiting condition for the present invention and con be adjusted according to different appearance requirements. The following embodiments will illustrate the design of the antenna structure of different shapes, and the operation principle thereof is substantially the same as that of the antenna structure 100 of the FIG. 1.

Figure 2:
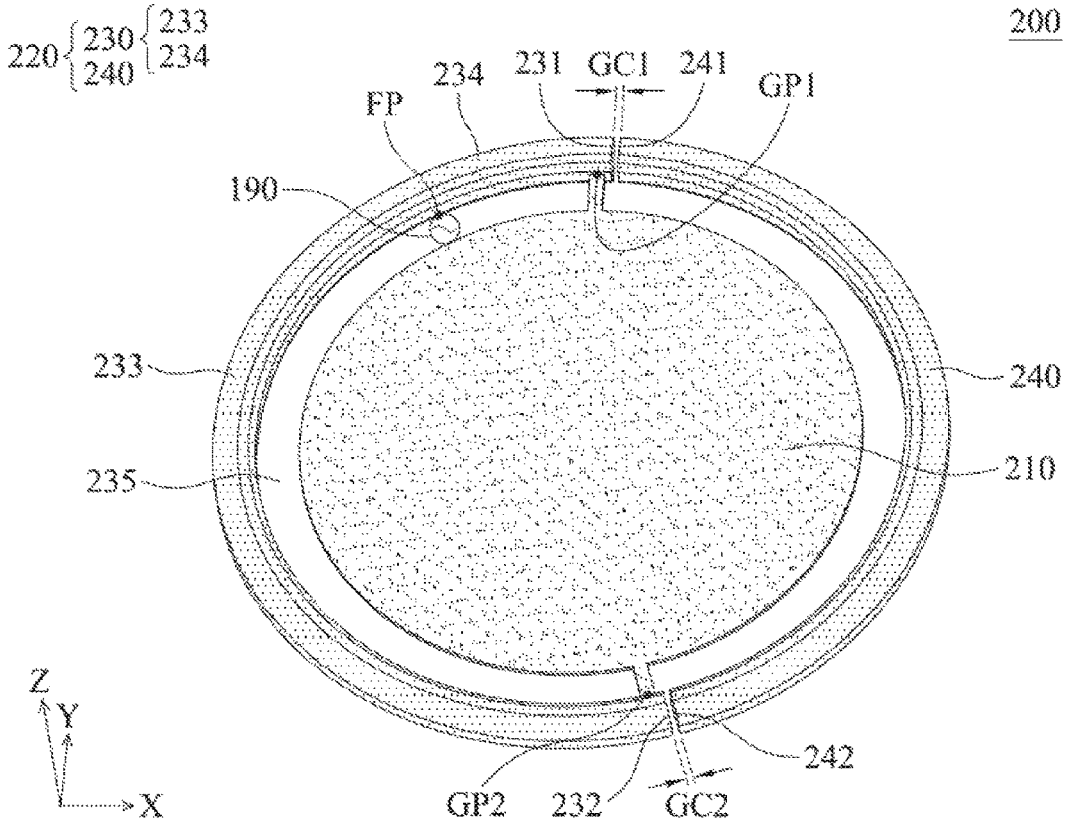
FIG. 2 is a perspective view of an antenna structure according to another embodiment of the present invention.

FIG. 2 is a perspective view of an antenna structure according to an embodiment of the present invention. A ground element 210 of an antenna structure 200 is substantially a round metal plate. A metal loop 220 of the antenna structure 200 is substantially a hollow round frame to accommodate the round ground element 210 in a corresponding manner. Other features of the antenna structure 200 of FIG. 2 are similar to those of the antenna structure 100 of FIG. 1. Accordingly, the two embodiments can achieve similar levels of performance.

Figure 3:
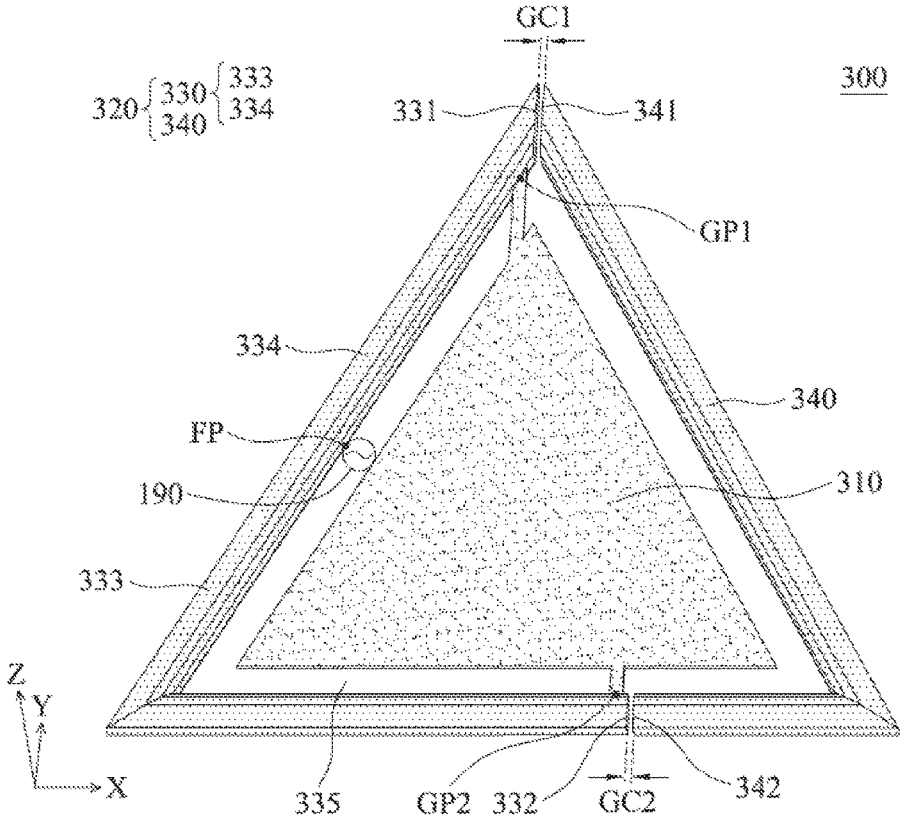
FIG. 3 is a perspective view of an antenna structure according to another embodiment of the present invention.

FIG. 3 is a perspective view of an antenna structure according to an embodiment of the present invention. A ground element 310 of an antenna structure 300 is substantially triangle metal plate. A metal loop 320 of the antenna structure 300 is substantially hollow triangle frame to accommodate the round grounding element 310 in a corresponding manner. Other features of the antenna structure 300 of FIG. 3 are similar to those of the antenna structure 100 of FIG. 1. Accordingly, the two embodiments can achieve similar levels of performance.

Figure 4:
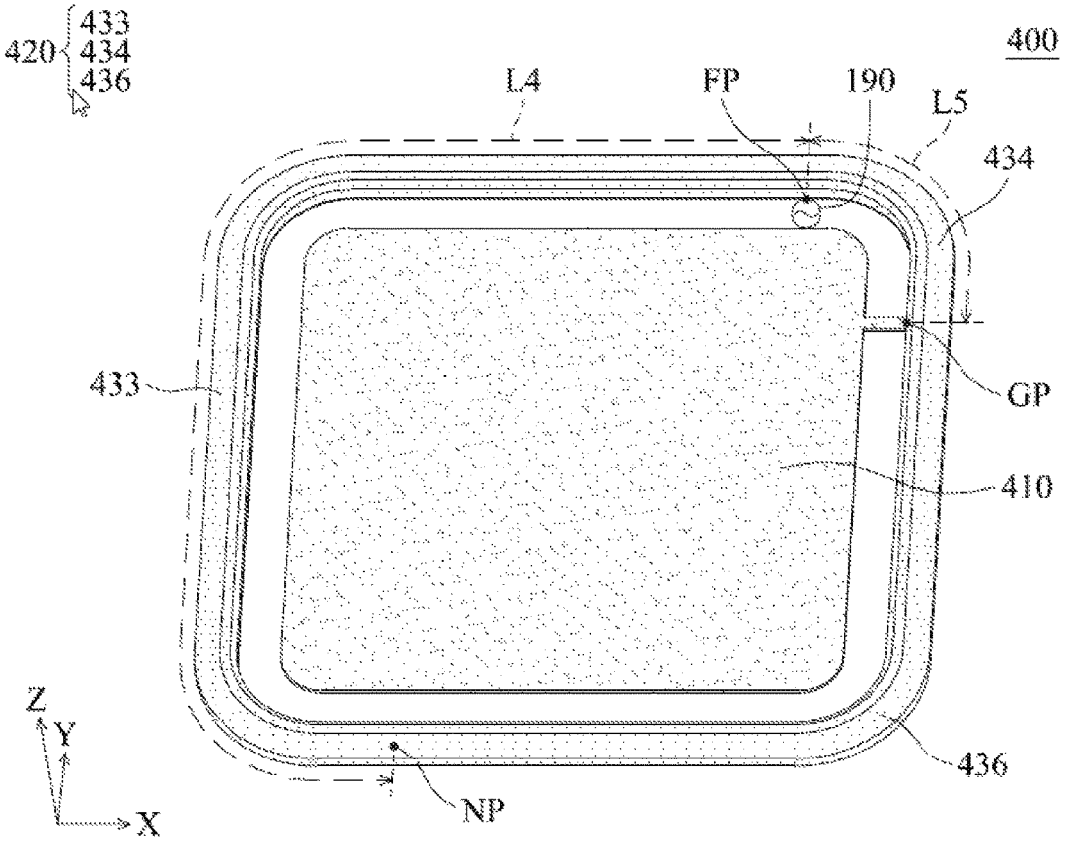
FIG. 4 is a perspective view of an antenna structure according to another embodiment of the present invention.

FIG. 4 is a perspective view of an antenna structure according to an embodiment of the present invention. An antenna structure 400 may be a simplified version of the antenna structure 100 of the FIG. 1, it also can achieve similar levels of performance. For example, antenna structure 400 can cover an operation frequency band, and the operation frequency band is from 2403 MHz to 2483.5 MHz. In this embodiment, the antenna structure 400 includes a ground element 410 and a metal loop 420, the ground element 410 is substantially surrounded by the metal loop 420. There is no break or coupling gap on the metal loop 420, so the metal loop 420 is a complete loop shape. This can reduce the manufacturing complexity of the antenna structure 400. The metal loop 420 includes a feeding point FP and a shorting point GP. The feeding point FP is coupled to a signal source 190, and the shorting point GP is coupled to the ground element 410. When the antenna structure 400 is excited, a current null point NP is generated on the metal loop 420, wherein a current density at the current null point NP is almost zero, can be regarded as a virtual short-circuit point. In detail, the metal loop 420 includes a radiation branch 433 and a tuning branch 434. The radiation branch 433 is disposed between the feeding point FP and current null point NP, and the tuning branch 434 is disposed between feeding point FP and the shorting point GP. A length of the radiation branch 433 is greater than a length of the tuning branch 434. For example, the length of the radiation branch 433 may be at least three times the length of the tuning branch 434. In principle, the radiation branch 433 is a higher portion of current density of the antenna structure 400 as a main resonance path, and the tuning branch 434 is used to provide the inductance characteristic to fine tune the impedance matching of the antenna structure 400. It should be noted that the current density on the remaining portion 436 of the metal loop 420 is relatively low, so that there is little impact on the radiation characteristics of the antenna structure 400. A length L4 of the radiation branch 433 is substantially equal to one wavelength (1λ) of a central frequency of the operation frequency band of the antenna structure 400, and a length L5 of the tuning branch 434 is substantially shorter than 0.25 wavelength (0.25λ) of a central frequency of the operation frequency band of the antenna structure 400. Other features of the antenna structure 400 of FIG. 4 are similar to those of the antenna structure 100 of FIG. 1. Accordingly, the two embodiments can achieve similar levels of performance.

The invention proposes a novel antenna structure. In comparison to the conventional design, the invention has at least a small size, a broad band, low cost and low manufacturing complexity. In addition, the antenna structure of the present invention can be integrated with the metal appearance elements of the device, so that it can be used to beautify the appearance of the apparatus and to provide stylish visual effects. The present invention is suitable for use in various portable articles or wearable devices.

Note that the above element sizes, element parameters, element shapes, and frequency ranges are not limitations of the invention, unless otherwise expressly embodied in the claims. An antenna designer of ordinary skill in the art can fine-tune these settings or values according to different requirements. It should be understood that the antenna structure of the invention is not limited to the configurations of FIGS. 1-4. The invention may merely include any one or more features of any one or more embodiments of FIGS. 1-4. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:
a ground element; and
a metal loop, comprising:
a main radiation element, wherein the main radiation element includes a feeding point, a first shorting point and a second shorting point, the first shorting point and the second shorting point are coupled to the ground element, and the feeding point is substantially positioned between the first shorting point and the second shorting point; and
a float radiation element being adjacent to the main radiation element, and being separated from the ground element and the main radiation element;
wherein the ground element is substantially surrounded by the metal loop, and wherein the float radiation element is a director of the main radiation element for providing an approximately omni-directional radiation pattern.

2. The antenna structure as claimed in claim 1, wherein the main radiation element comprises a first end and a second end away from each other, the first shorting point is positioned on the first end of the main radiation element, and the second shorting point is positioned on the second end of the main radiation element.

3. The antenna structure as claimed in claim 2, wherein the float radiation element comprises a first end and a second end away from each other, a first coupling gap is formed between the first end of the float radiation element and the first end of the main radiation element, and a second coupling gap is formed between the second end of the float radiation element and the second end of the main radiation element.

4. The antenna structure as claimed in claim 1, wherein the antenna structure covers an operation frequency band, and the operation frequency band is from 2403 MHz to 2483.5 MHz.

5. An antenna structure, comprising:
a ground element; and
a metal loop, comprising:
a main radiation element, wherein the main radiation element includes a feeding point, a first shorting point and a second shorting point, the first shorting point and the second shorting point are coupled to the ground element, and the feeding point is substantially positioned between the first shorting point and the second shorting point; and a float radiation element being adjacent to the main radiation element, and being separated from the ground element and the main radiation element;

wherein the ground element is substantially surrounded by the metal loop, wherein the antenna structure covers an operation frequency band, and the operation frequency band is from 2403 MHz to 2483.5 MHz, and wherein the main radiation element comprises a radiation branch and a tuning branch, the radiation branch is positioned between the feeding point and the second shorting point, the tuning branch is positioned between the feeding point and the first shorting point, the radiation branch is a main radiation path of the antenna structure, and the tuning branch is used to fine-tune an impedance matching of the antenna structure.

6. The antenna structure as claimed in claim 5, wherein the radiation branch is extended along an edge of the ground element, and a slot region is formed between the radiation branch and the ground element.

7. The antenna structure as claimed in claim 6, wherein a length of the slot region is substantially equal to a wavelength of a central frequency of the operation frequency band.

8. The antenna structure as claimed in claim 5, wherein a length of the tuning branch is shorter than 0.25 wavelength of a central frequency of the operation frequency band.

9. An antenna structure, comprising:

a ground element; and a metal loop, comprising a feeding point and a shorting point, wherein the shorting point is coupled to the ground element;

wherein the ground element is substantially surrounded by the metal loop, wherein a current null point is generated on the metal loop when the antenna structure is excited, and wherein the metal loop further comprises a radiation branch and a tuning branch, the radiation branch is positioned between the feeding point and the current null point, the tuning branch is positioned between the feeding point and the shorting point, the radiation branch is a main radiation path of the antenna structure, and the tuning branch is used to fine-tune an impedance matching of the antenna structure.

* * * * *